United States Patent [19]

Aschke

[11] 3,999,466

[45] Dec. 28, 1976

[54] HYDROSTATIC PUMP/MOTOR UNIT

[76] Inventor: Eckhard Aschke, 15807 Las Vecinas Drive, Apt. 7, La Puente, Calif. 91744

[22] Filed: Oct. 25, 1973

[21] Appl. No.: 399,645

[30] Foreign Application Priority Data

June 30, 1973 Germany ..... 2333380

[52] U.S. Cl. ..... 91/499

[51] Int. Cl.[2] ..... F01B 13/04

[58] Field of Search ..... 91/6.5, 499

[56] References Cited

UNITED STATES PATENTS

| | | | |
|---|---|---|---|
| 3,094,078 | 6/1963 | Brueder | 91/6.5 |
| 3,157,130 | 11/1974 | Cadiou | 91/6.5 |
| 3,200,761 | 8/1965 | Firth et al. | 91/6.5 |
| 3,362,342 | 1/1968 | Flint et al. | 91/482 |
| 3,520,229 | 7/1970 | Slimm et al. | 91/6.5 |
| 3,727,521 | 4/1973 | Reynolds | 91/475 |
| 3,847,057 | 11/1974 | Bosch | 91/6.5 |
| 3,858,483 | 1/1975 | Hein | 91/6.5 |

FOREIGN PATENTS OR APPLICATIONS

| | | | |
|---|---|---|---|
| 684,551 | 12/1952 | United Kingdom | 91/499 |

*Primary Examiner*—William L. Freeh

*Attorney, Agent, or Firm*—Poms, Smith, Lande & Glenny

[57] ABSTRACT

A hydrostatic pump/motor unit has a cylinder system that is positively controlled by a relatively revolving porting means having suction and pressure ports separated by dead center areas therebetween which are interconnected by canal means for compensating the pressure between cylinder ports of the system which have left communication with the suction port and cylinder ports which have left communication with the pressure port wherein the ends of the canal means are provided with openings in the dead center areas that are larger than the distance between cylinder ports and the circumferential distance between such openings and the pressure port and between such openings and the suction port on both sides of each of said openings is greater than the diameter of the individual cylinder ports so that an exchange of pressure occurs first between neighboring cylinders passing over one of the openings and then between such neighboring cylinders and the non-adjacent cylinder in the other dead center area.

3 Claims, 2 Drawing Figures

HYDROSTATIC PUMP/MOTOR UNIT

Figure 1:
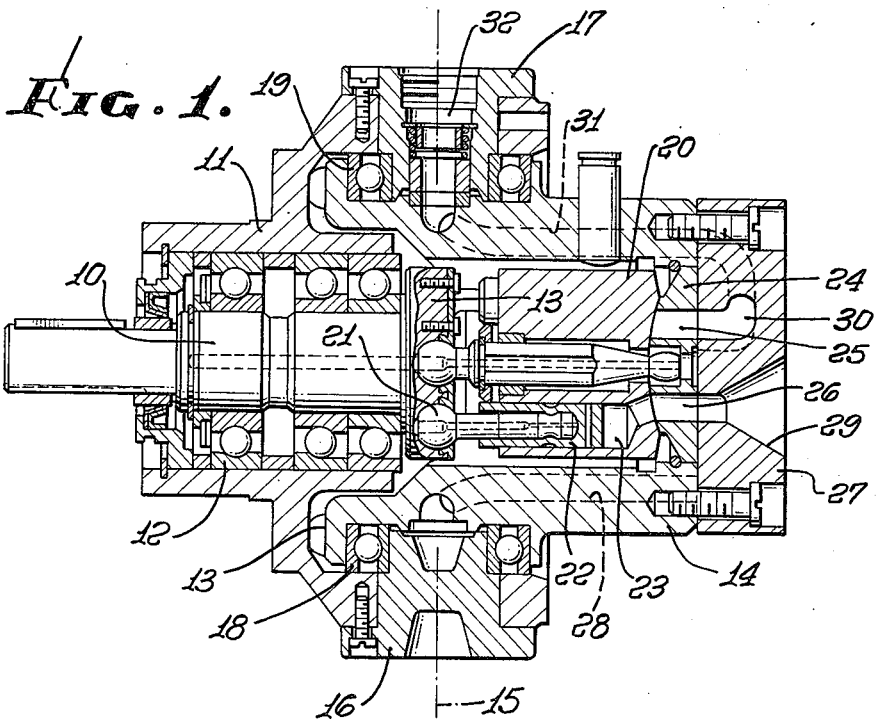

The invention concerns a hydrostatic pump/motor unit with a piston system, which is positively controlled by a porting plate or porting shaft with suction and pressure ports, where the suction and pressure ports are separated at the section of the dead center.

The disadvantage of the know piston systems is, that the compressed remaining rest oil left in the cylinders after each pressure stroke will be relieved into the suction port. This causes, depending on the volume of the remaining rest oil, variations in compression losses.

Another disadvantage of the known piston systems is, that there is usually an overlapping angle (where cylinder ports have no connection with either pressure or suction port) of approximately 3° to 12°. This generates a more or less high noise level.

The mass reversion of the pistons in the dead centers causes a high tension on the piston shoe or the piston suspension. The rate of feeding or eventually cavitation of the hydrostatic machine may also cause an exceptionally high tension on the piston suspension which is always combined with a high noise level. With the known piston systems the optimum between the number of cylinders and the delivery pulsation with the lowest oil leakage on the porting plate resp. porting shaft has been reached with 7 cylinders. The delivery pulsation is then 2,5 %.

The purpose of this invention is to design a hydrostatic pump / motor unit of the before mentioned type, where compression losses, noise and delivery pulsation are reduced.

This is accomplished through the invention by pressure compensation in the section of the dead centers through a canal between the cylinder ports, which left the suction port and the cylinder ports, which left the pressure port. Through this pressure compensation the compression volume is used for pre-compression, whereby the pressure of the remaining rest oil in the cylinders is reduced 50 %, assuming a 100 % filling of the cylinders, before the cylinder port connects to the suction port. With this, also the compression losses are reduced at least 50 % and the efficiency of the hydrostatic unit is increased equivalently. Now, almost any overlapping angle can be used on the porting plate resp. porting shaft. The increase as well as the decrease of pressure takes place in 2 steps and is correspondingly slower, which results in an exceptionally low noise level. The mass reversion of the pistons in the dead centers takes place under the load of approximately half the working pressure. This prevents the pistons from being lifted out of their support by means of cavitation and mass force. The porting plate resp. porting shaft is pressurized symmetrically, which reduces the force of adjustment when the delivery volume is adjusted. By means of the large overlapping angles, which are now possible, the hydrostatic unit can be run at speeds two to three times higher than before, without the danger of cavitation. Therefore, units with the same weight but 2 – 3 times higher cavity can be build now. The lower adjustment forces necessary for the adjustment of the piston system also result in a reduction of the reaction time when the volume is changed. By increasing the number of cylinders to 13 or 15 the new unit reduces the delivery pulsation to less than 1 %. This also effects the vibration behavior of the hydraulic system in a favourable way.

In the new hydrostatic unit the required pressure compensation is best maintained when the pressure compensation canal is placed in the porting plate or porting shaft.

The undesirable connection between the suction port and the pressure port through the compensation canal is being prevented through the distance of the suction port and pressure port in the area of the dead centers, which is equivalent to double the dimension of a cylinder port plus the width of the pressure compensation canal.

The pressure increase and decrease in the cylinders, while they pass through the dead centers, is favourably influenced through the fact, that the ends of the pressure compensation canal are formed to function as accumulator chambers.

Figure 2:
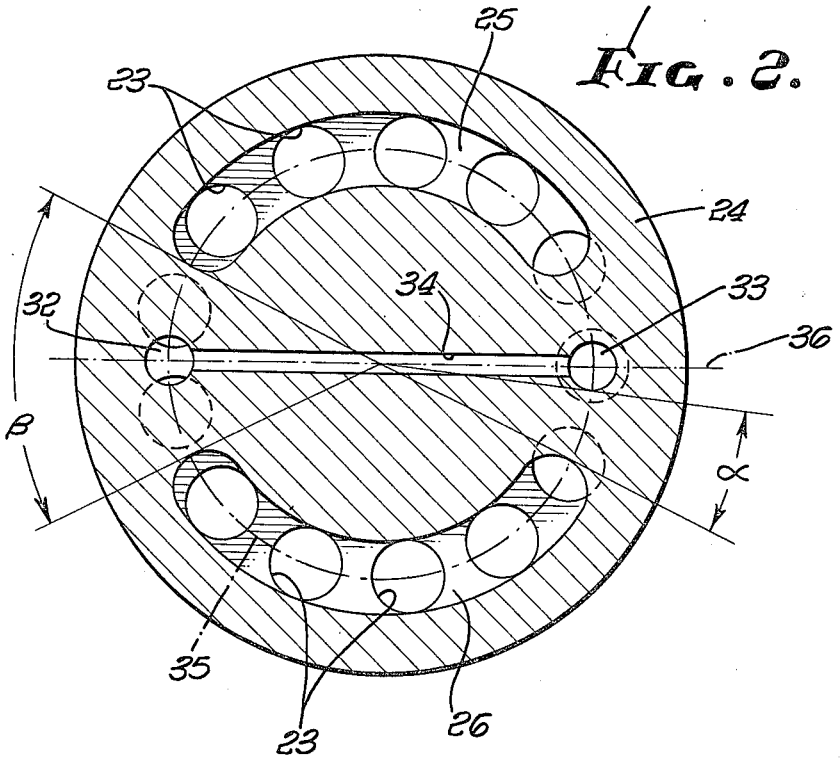

The invention is closer described by an example shown in the drawings, which show:

FIG. 1 Sectional view of an axial piston system with bent-axis-design as variable pump and FIG. 2 Control system on a fixed porting plate of the unit according to FIG. 1

When used as a pump, the drive shaft 10 of the hydrostatic unit is powered by a motor, e.g. electric motor. This drive shaft 10 is revolvingly positioned in the housing 11 by the ball bearing 12. The cylinders 23 which are located in the block 20 contain the pistons 22, whose piston rods end in ball joints 21, which are positioned in the joint plate 13, which is positively locked to the drive shaft 10 and revolve together. The cylinder block 20 is covered first by a housing 14 and second by a spherical porting plate 24. The housing 14 can be swivelled through the swivel axis 15 on ball bearings 18 and 19 relative to the housing 11. The canals 28 and 31 are placed symmetrically in the housing 14 and lead from the porting plate 24 to the outlet sockets 16 and 17, which are solidly joined to the housing 11. The symmetrical location of the canals 28 and 31 enables the unit to run in both directions and also allows the unit to be used as pump or motor.

The porting plate 24 is supported on a housing plate 27 in which a tapered suction port 29 is located, which leads into the suction port 26 of the porting plate 24. The pressure port 25 runs through canal 30 of the housing plate 27 into canal 31 of the housing 14 and to outlet port 32 out of the socket 17.

When the drive shaft 10 is turned to the right, the hydraulic fluid is taken in through suction port 26 and is pressed out through the pressure port 25. Since the axis of the piston system is inclined towards the drive shaft 10, the pistons 22 are periodically shifted by the movement of the joint plate 13 and are therefore used alternately to take in the hydraulic fluid into the cylinders 23 and to press out the hydraulic fluid of the cylinders 23. By changing the inclination of the piston systems toward the drive shaft 10 the stroke of the pistons 22 within the cylinders 23 can be either shortened or lengthened. This leads to an increase or decrease of the delivery.

As shown in FIG. 2, the ports of the 13 cylinders 23 are arranged in a circle 35, which is identical with the radius of the kidneyshaped suction port 26 and with the radius of the kidneyshaped pressure port 25 of the porting plate 24. The overlapping angle $\beta$ between the two ports 25 and 26 of the porting plate 24 is considerably larger than on any known hydrostatic unit, e.g. in the range of up to 50°. The diameter 36 of the porting plate 24 marks the dead centers of the piston system.

On this diameter 36 there is a compensation canal 34 built in the porting plate 24, which is formed on its ends 32 and 33 to function as accumulator chambers with a larger cross section and volume.

The cylinder ports 23, which have left the suction port 26, and passed through angle $\alpha$, are connected through the pressure compensation canal 34 with the cylinder ports 23, which have left the pressure port 25. Thus a pressure compensation is taking place that leads gradually to a pressure decrease and pressure increase in the piston system. Since the angle $\beta$ (the distance between the pressure port 25 and the suction port 26) is a section of circle 35, which is larger than double the diameter of the cylinder ports 23 plus the width of the pressure compensation canal, i.e. the accumulator chambers 32 and 33, it is absolutely certain, that the pressure compensation canal 34 never directly connects the suction port 26 and the pressure port 25.

As shown in FIG. 2 the ends of the canal means 34 are provided with openings 32,33 in said dead center areas that are larger than the distance between cylinder ports 23 so that an exchange of pressure occurs between neighboring cylinders passing over one of said openings.

I claim:

1. In a hydrostatic pump/motor unit with a cylinder system that is positively controlled by a relatively revolving porting means having suction and pressure ports, said suction and pressure ports being separated by dead center areas therebetween, the improvement in porting means comprising the provision of:

canal means (34) for connecting the dead center areas (36) for compensating the pressure between cylinder ports (23) of said system which have left communication with the suction port (26) and cylinder ports (23) which have left communication with the pressure port (25), said canal means and porting means being so arranged relative to said cylinder system that periodically a pair of non-adjacent cylinder ports are connected to one another through said canal means for pressure compensation therebetween and such pressure compensation starts only after such two cylinder ports have completely left respectively said pressure and suction ports, wherein:

ends of the canal means (34) are provided with openings (32,33) in said dead center areas that are larger than the distance between cylinder ports (23) and the circumferential distance between the canal means openings (32,33) and the pressure port (25) and between said openings (32,33) and the suction port (26) on both sides of each of said openings (32,33) is greater than the diameter of the individual cylinder ports (23) so that an exchange of pressure occurs first between neighboring cylinders passing over one of said openings and then between said neighboring cylinders and the non-adjacent cylinder in the other dead center area.

2. A hydrostatically operated unit having a piston and cylinder system operated in conjunction with porting means for connecting cylinders of said system alternatively to suction and pressure ports of said porting means, said system and porting means being mounted for relative rotational movement to move cylinder ports of said system alternately into communication with said pressure and suction ports, areas between said suction and pressure ports defining dead center areas, the improvement comprising the provision of:

canal means including openings in said dead center areas for connecting said dead center areas to one another for communicating hydrostatic pressure of cylinders of said system whose cylinder port has left said suction port with other cylinder port of a cylinder of said system which has left said pressure port, as said cylinder ports move relatively past said dead center areas respectively, and wherein said porting means is so provided that the circular distance of separation of said suction port and said pressure port in each of said areas of said respective dead centers is equivalent to approximately twice the diameter of a cylinder port of said system plus the width of an opening of said canal means at such dead center area, whereby an effective pressure compensation starts only after a cylinder port has left completely one of said pressure and suction ports, wherein:

said cylinder system comprises an odd number of eleven or more cylinders having a spacing distance between cylinder ports smaller than the diameter of a canal means opening in a dead center area and the circumferential distance between the canal means openings and the pressure port and between said openings and the suction port on both sides of each of said openings is greater than the diameter of the individual cylinder ports so that an exchange of pressure occurs first between neighboring cylinders passing over one of said openings and then between said neighboring cylinders and a third cylinder in the other dead center area.

3. The method of operating a hydrostatic pump/motor unit with a cylinder system that is positively controlled by a relatively revolving porting means having suction and pressure ports separated by dead center areas comprising the steps of:

connecting a cylinder port of a cylinder of said system which has completely left the suction port with a cylinder port of a cylinder of said system which has completely left the pressure port through a canal means having openings in said dead center areas and wherein the circumferential distance between the canal means openings and the pressure port and between said openings and the suction port on both sides of each of said openings is greater than the diameter of the individual cylinder ports to provide a pressure compensation between such connected cylinder ports only after they have left said pressure and suction ports respectively and communicating a pair of adjacent cylinder ports of an odd number of eleven or more cylinders to each other during said step of connecting whereby when any one cylinder enters the pressure compensation step, two other already pressure compensated cylinders are in connection with each other so that pressure compensation over the shorter distance between said one cylinder and the adjacent cylinder of said two others occurs first and then between the two adjacent cylinders and the third cylinder in the opposite dead center area.

* * * * *